US009390647B2

(12) United States Patent
Li et al.

(10) Patent No.: US 9,390,647 B2
(45) Date of Patent: Jul. 12, 2016

(54) PULSE WIDTH CORRECTION FOR LED DISPLAY DRIVER

(71) Applicant: SCT TECHNOLOGY, LTD., Grand Cayman (KY)

(72) Inventors: Eric Li, Milpitas, CA (US); Shang-Kuan Tang, Fremont, CA (US); Wenjie Yang, GuangDong (CN); Yi Zhang, San Jose, CA (US)

(73) Assignee: SCT TECHNOLOGY, LTD., Grand Cayman (KY)

( * ) Notice: Subject to any disclaimer, the term of this patent is extended or adjusted under 35 U.S.C. 154(b) by 0 days.

(21) Appl. No.: 14/337,165

(22) Filed: Jul. 21, 2014

(65) Prior Publication Data

US 2016/0019829 A1 Jan. 21, 2016

(51) Int. Cl.

| | |
|---|---|
| ***G09G 3/30*** | (2006.01) |
| ***G09G 3/34*** | (2006.01) |
| ***G09G 3/32*** | (2016.01) |

(52) U.S. Cl.

CPC ..... *G09G 3/32* (2013.01); *G09G 3/3413* (2013.01); *G09G 2320/0285* (2013.01); *G09G 2320/064* (2013.01); *G09G 2320/0666* (2013.01); *G09G 2330/06* (2013.01)

(58) Field of Classification Search

CPC ..... G09G 3/32; G09G 3/3413
USPC ..... 345/76, 102
See application file for complete search history.

(56) References Cited

U.S. PATENT DOCUMENTS

| | | | | |
|---|---|---|---|---|
| 2008/0197789 | A1* | 8/2008 | Shiotsu | H05B 33/0815 315/297 |
| 2010/0327972 | A1* | 12/2010 | MacLean | H03K 5/131 330/251 |
| 2012/0327128 | A1* | 12/2012 | Li | G09G 3/32 345/690 |
| 2012/0327129 | A1* | 12/2012 | Li | G09G 3/32 345/690 |

* cited by examiner

*Primary Examiner* — Adam J Snyder
(74) *Attorney, Agent, or Firm* — Novick, Kim & Lee, PLLC; Allen Xue

(57) ABSTRACT

The LED display system comprises an array of LEDs and a driver circuit that employs a scrambled PWM generator. The scrambled PWM generator is configured to generate a plurality of PWM pulses. The PWM pulses are distributed into a corresponding number of refresh segments. The driver circuit is configured so that one or more of PWM pulses are extendable by a certain offset value so that the pulse width in the corresponding refresh segments is wide enough for the LED to emit light.

16 Claims, 2 Drawing Sheets

PULSE WIDTH CORRECTION FOR LED DISPLAY DRIVER

THE TECHNICAL FIELD

The present disclosure relates generally to methods and devices for driving a LED display panel. More particularly, this disclosure relates to methods and devices that enable high gray scale values and refresh rates for LED display panels.

BACKGROUND

Modern LED display panels require higher gray scale to accomplish higher color depth and higher visual refresh rate to reduce flickering. For example, a 16-bit gray scale for a RGB LED pixel may allow 16 bit levels ($2^{16}$=65536) for R, G, B LEDs respectively. Such a RGB LED pixel is capable of displaying a total of $65536^3$ colors. One method commonly employed to adjust LED gray scale is PWM (Pulse Width Modulation). Simply put, PWM turns an LED on or off according to the width of the signal pulse (i.e., pulse duration or pulse width). The ratio between the on time and the off time in turn determines the brightness of the LED. A different ratio represents a different gray scale. Configurations and operations of LED display systems, including LED topology, circuitry, PWM and PWM engines are explained in detail in copending U.S. application Ser. No. 13/237,960, filed Sep. 21, 2011.

Pulse-width modulation (PWM) modulates the width of the pulse based on the modulator signal information. PWM uses rectangular pulse waves whose pulse widths are modulated, resulting in the variation of the average value of the waveform. The common implementation of PWM is to allow the control of power supplied to electronic devices, typically inertial loads such as incandescent lamps and motors. The average value of voltage or current fed to the load is controlled by turning the switch between supply and load on and off at a fast pace. The longer the ON period compared to the OFF period of the switch, the higher the power is supplied to the load.

One of the main advantages of PWM is that power loss in the switching devices is low. When a switch is turned off, there is practically no current. When the switch is turned on, there is almost no voltage drop across the switch. As a result, power losses in these two cases are close to zero. Potential drawbacks to PWM are the pulsations defined by the duty cycle, switching frequency and properties of the load. When the switching frequency is sufficiently high, the pulse train can be smoothed by using additional passive electronic filters and the average analog waveform can be recovered.

High-frequency PWM power control systems are realized with semiconductor switches, but during the transitions between the ON and OFF states both voltage and current are nonzero. As a result, certain power is dissipated in the switches. When the switching between the ON and Off states is sufficiently fast, the power dissipation in the switches is low compared to the power delivered to the load. Modern semiconductor switches such as MOSFET and IBGT are well suited for high efficiency controllers.

Compared with inert light sources, such as incandescent lamps, LEDs turn on and off very rapidly. Consequently, if supplied with a low frequency drive voltage, the LED will flicker. Perceivable flicker effects from such rapid response light sources can be reduced by increasing the PWM frequency. When the frequency of light fluctuation is high enough to passthe flicker fusion threshold, the human visual system can no longer resolve them and the eyes receive the time averaged intensity without flicker. PWM is also implemented in efficient voltage regulators. By switching voltage with an appropriate duty cycle, the output will approximate a voltage at the desired level. The switching noise is usually filtered with an inductor and a capacitor.

Scrambled-PWM (S-PWM) is a modified version of the conventional PWM. When applied in LED display, the S-PWM scheme splits (or "scrambles") an on time into multiple shorter on periods and distribute them into a number of refreseh segments. By doing so, S-PWM improves the visual refresh rate of the display. Therefore, as explained further below, S-PWM supports high gray scale controls, which allows for greater color resolution and clarity.

A PWM period usually consists of a plurality of clock cycles (gray scale clock or GCLK) equal to the 2 to the power of the number of control bits:

$$\text{GCLK cycles}=2^{NUMBER_OF_CONTROL_BITS}$$

For example, a 16-bit gray scale has 65536 GCLK cycles (or GCLK numbers). The total number of GCLK can be divided into MSB (most significant bits) and LSB (least significant bits) of gray scale cycles. Each frame data is divided into a number of refresh segments according to the following equation:

$$\text{Number_of_Segments}=2^{bit\text{-}number\text{-}of\text{-}LSB}$$

The MSB value corresponds to the number of GCLKs that the LED shall be on within a single refresh segment.

FIG. 1 compares conventional PWM, S-PWM, and the modified S-PWM according to current invention (labeled as "S-PWM-AddingN). In conventional PWM, all 320 GCLK cycles occur continuously. Consequently, the LED only lights up for a short period of time. According to the conventional S-PWM scheme shown in FIG. 1, the bit number of MSB is set at 11 and the bit number of LSB is set at 5. (MSB and LSB bit numbers can be 10 and 6, respectively, or any other suitable combinations.) The frame data is divided into 32 (i.e., $2^5$=32) refresh segments (i.e., Segment 0 to Segment 31). According to the conventional S-PWM scheme, a total of 320 GCLK cycles are distributed into 32 segments. Each segment has 10 GCLK cycles. If the duration of 10 GCLK cycles (i.e., the pulse width in a refresh segment) is long enough for the LED to light up, the LED will emit light 32 times using the S-PWM scheme in contrast to emitting light only one time when using the conventional PWM scheme.

Note that the total number of GCLK cycles does not change in the S-PWM scheme. Therefore, if the data frame is divided into a larger number of refresh segments (therefore higher visual refresh rate), each segment would have a narrower PWM pulse, this would pose a problem for LED displays.

In an LED display system, the constant current source capacitance loading (including that of PCB traces and LEDs) defines the rise time ($T_r$) and the fall time ($T_f$) of output voltage and output current. In general, the capacitance loading can be in hundreds of Pico Farad, which results in $T_r$ values bigger than 100 nanosecond. Such a $T_r$ value indicates that it takes a long time to raise the voltage of the LED above its forward voltage ($V_f$).

As illustrated in FIGS. 2A-2C, if the PWM pulse width is too narrow, the voltage crossing LED does not have sufficient time to rise to $V_f$. In this case, the current only charges parasitic capacitance. In other words, if the PWM pulse width is smaller than $T_r$, the LED would not emit light. This limits the maximum value of GCLK frequency and in turn limits the value of the gray scale and the refresh rate.

Therefore, there is a need for devices and methods that allow higher GCLK frequencies (or narrower PWM pulses)

in an LED display system so that the LED display can achieve higher gray scales and higher refresh rates.

SUMMARY OF INVENTION

In one embodiment, there is provided an LED display system. The LED display system comprises a plurality of LDEs arranged into an LED array with rows and columns. The LEDs can be either RGB LEDs or single color LEDs. The LED array may be arranged in a common cathode configuration, in which each of a plurality of common cathode nodes is connected with cathodes of the LEDs of a same color in a same row. The common cathode nodes are operably connected to power sources. Alternatively, the LED array may be arranged in a common anode configuration, in which each of a plurality of common anode nodes is connected with anodes of LEDs of a same color in the same column. The common anode nodes are operably connected to power sources.

The LED display system further comprises a driver circuit that drivers the LED array. The driver circuit employs a scrambled PWM generator. The scrambled PWM generator is configured to generate a plurality of PWM pulses. According to one embodiment, the driver circuit is configured so that one or more of the plurality of PWM pulses are extendable by an offset value. According to a further embodiment, the driver circuit is configured so that a pre-determined offset value can be loaded into a register in the driver circuit. When the offset value is a positive number, the PWM pulse width is extended by an amount equaling the offset value. When the value of N is zero, the LED display system operates in a conventional S-PWM mode.

The offset value can be determined by measuring one or more performance characteristics of the LED display system, e.g., brightness, visual refresh rate, etc., in response to a varying offset value. The offset value that yields the desired performance characteristics can be selected and loaded into the register. Alternatively, the offset value can be calculated according to certain mathematical equations.

In another embodiment, there is provided a method for operating a LED display. The method comprises the steps of connecting an array of LEDs to a driver circuit, wherein the driver circuit comprises a scrambled PWM generator. The scrambled PWM generator is configured to generate a plurality of PWM pulses. The method further comprises extending the width of each of the plurality of PWM pulses by adding to it an offset value so that the PWM pulse width exceeds the rise time of the LEDs. The PWM pulse width is extended by the offset value when the offset value is a positive number. When the offset value is zero, the LED display is operated in a conventional S-PWM scheme.

DESCRIPTIONS OF DRAWINGS

The teachings of the present disclosure can be readily understood by considering the following detailed description in conjunction with the accompanying drawings.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 1:
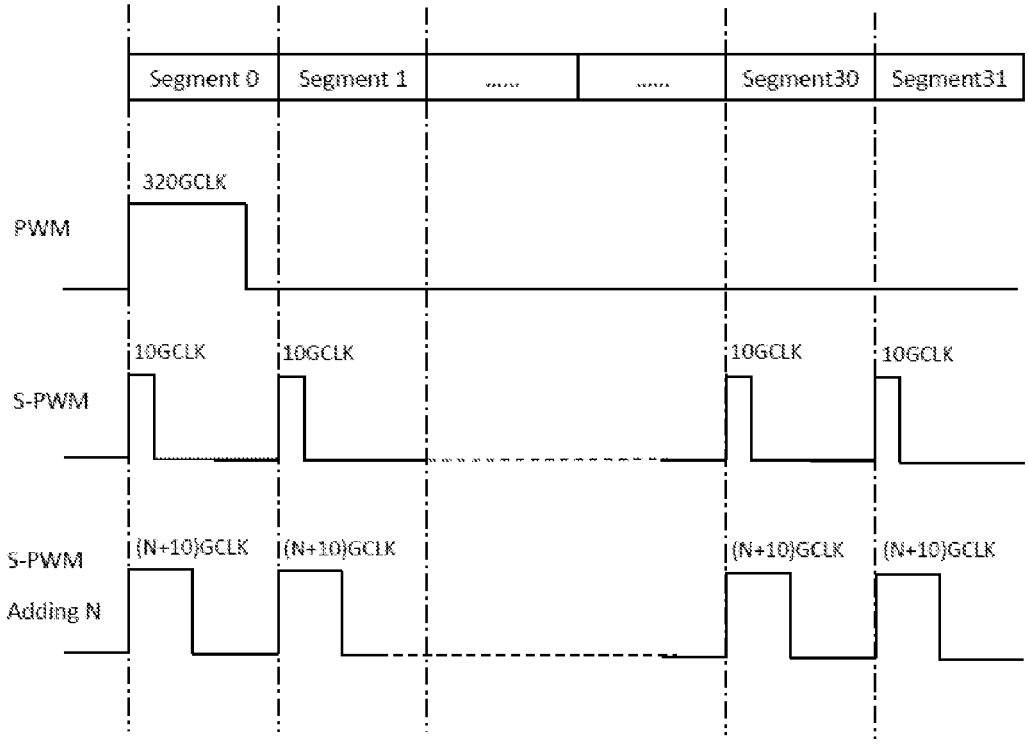
FIG. 1 is a diagram illustrating conventional PWM, S-PWM, and modified S-PWM according to the current invention, labeled as S-PWM-AddingN.

One aspect of the embodiment according to the current disclosure is illustrated in FIG. 1. In this case, the PWM value is 320, i.e., the total width for the PWM pulses equal 320 GCLK cycles. In the S-PWM scheme, the 320 GCLK cycles are distributed among 32 segments (Segment 0 to Segment 31) at a number of 10 GCLK cycles in each segment. In one embodiment of the current disclosure, in the S-PWM-AddingN scheme, an offset value that equals N GCLK cycles is added to the PWM pulse in each segment so that the PWM pulse width is extended by additional N GCLK cycles, resulting in pulses having a width of (N+10) GCLK cycles.

Figure 2:
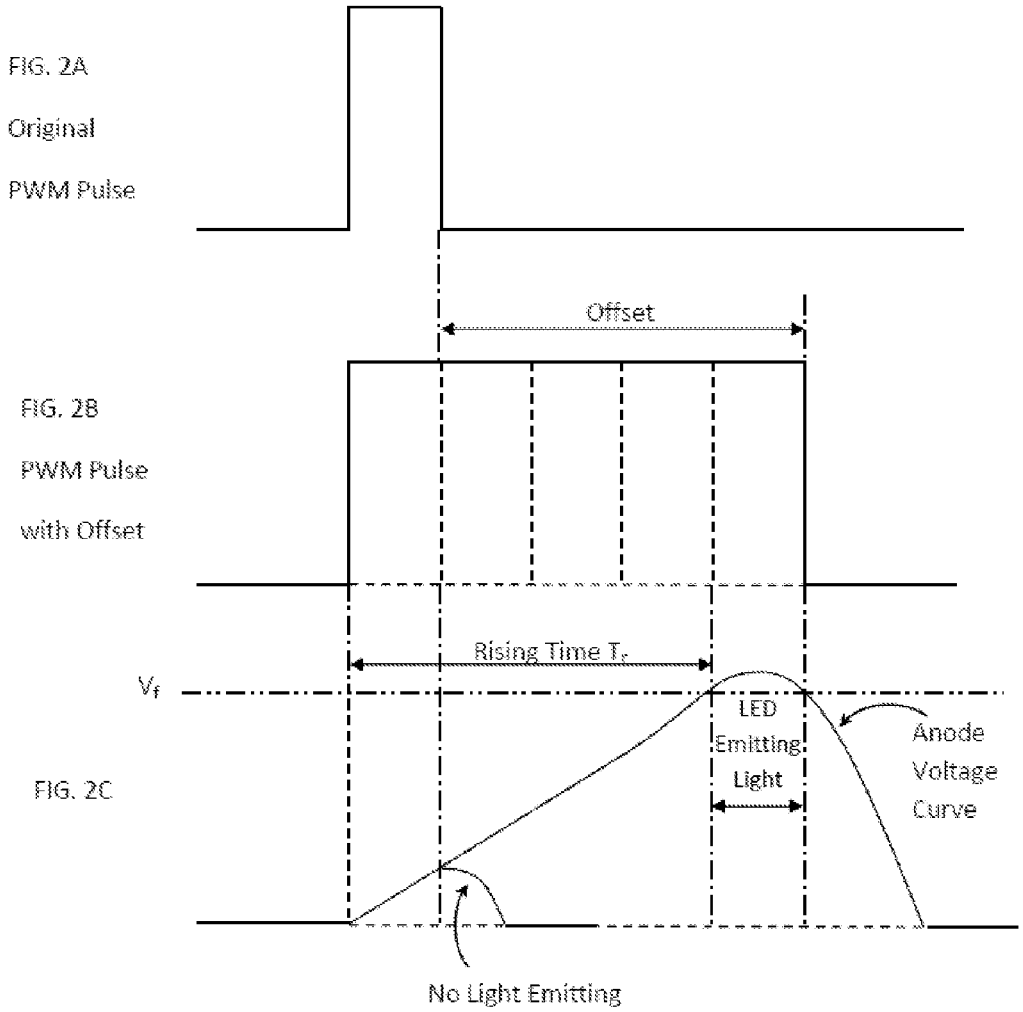
FIG. 2A is a diagram illustrating the original PWM pulse.
FIG. 2B is a diagram illustrating an embodiment of current disclosure, labeled as S-PWM-AddingN, where the PWM pulse is extended by an offset value.
FIG. 2C is a diagram showing the LED anode voltage curves corresponding to FIG. 2A and FIG. 2B.

FIGS. 2A-2C illustrate another aspect of the current disclosure. FIG. 2A shows the original PMW pulse, which has a width of one GCLK cycle. FIG. 2B shows the PWM pulse after adding an offset of 3 GCLK cycles. FIG. 2C illustrates the trajectory of the anode voltage of the LED in correspondence with the PWM pulse. As shown in FIG. 2C, the anode voltage rise time $T_r$ is longer than the width of the original pulse (which equals one GCLK cycle). Therefore, in the case illustrated in FIG. 2A, the anode voltage does not have sufficient time to rise to the forward voltage of the LED ($V_f$) before it starts to drop. Accordingly, the LED does not emit light.

In contrast, in the embodiment illustrated in FIG. 2B, since the pulse width is extended to 4 GCLK cycles, the anode voltage has sufficient time to rise above $V_f$. For the time period that the LED voltage is above $V_f$, the LED emits light. Therefore, adding an offset value of N GCLK cycles to the PWM pulse width enables the LED to emit light.

According to another aspect of the current disclosure, when there is no PWM pulse in a specific segment (i.e., the GCLK cycle number is zero), no offset value is added to that segment. However, if there is a PWM pulse (i.e., the original GCLK cycle number in that segment is not zero), the width of the PWM pulse is extended by a number that equals the offset value.

In a further embodiment of the current disclosure, the driver circuit is configured to receive, store, and send the data of the offset value. For example, the offset value can be pre-determined and loaded into a register. When the value of the offset is zero, the driver operates in the conventional S-PWM mode. When the offset is a positive number, the S-PWM pulses generated by the driver has an extra width equals to the value of the offset. Accordingly, the offset can be turned on or off by setting the offset value to zero or positive numbers, respectively.

In still a embodiment of the current disclosure, the offset value can be N GCLK cycles. The value of N can be calculated according to the following equation:

$$N=C*V_f*f_{GCLK}/I$$

whereby I is the LED driving current, C represents the LED and PCB loading, $V_f$ is the LED forward voltage and $f_{GCLK}$ is the GCLK frequency. When parameters in the equation above are the same, the offset value would be the same for each LED channel in a LED display panel. However, if the parameters vary among the LEDs in a display panel (e.g., the value of C and $V_f$ can differ slightly), the offset value would be different.

The offset value can be determined by empirical means, such as by measuring the performance characteristics of the LED display. For example, one may vary the offset value (e.g., loading a plurality of test values) and measure responses in one or more performance characteristics of the LED display in response to each test value. The test value at which the performance characteristic satisfies a certain performance criteria can be selected and loaded as the preferred offset value into the register. The performance characteristics may include the brightness, the refresh rate, or the resolutions of the LED display, or any other suitable characteristics. The performance criteria may vary for LED displays used in different applications.

Many modifications and other embodiments of the disclosure will come to the mind of one skilled in the art having the benefit of the teaching presented in the forgoing descriptions and the associated drawings. For example, the driver circuit can be used to drive an LED array in either common cathode or common anode configuration. Elements in the LED array can be single color LEDs or RGB units or any other forms of LEDs available. The driver circuit can be scaled up or scaled down to drive LED arrays of various sizes. Multiple driver circuits may be employed to drive a plurality of LED arrays in a LED display system. The components in the driver can either be integrated on a single chip or on more than one chip or on the PCB board. Such variations are within the scope of this disclosure. It is to be understood that the disclosure is not to be limited to the specific embodiments disclosed, and that the modifications and embodiments are intended to be included within the scope of the dependent claims.

What is claimed is:

1. An LED display system, comprising:

an array of LEDs arranged in rows and columns, each LED having an anode and a cathode; and a driver circuit that drives the array of LEDs, wherein the driver circuit comprises a scrambled PWM generator, wherein the scrambled PWM generator is configured to generate a plurality of PWM pulses, and the width of at least one of the plurality of PWM pulses is extendable by an offset value, wherein the offset value equals N GCLK cycles, wherein $N=C*V_f*f_{GCLK}/I$, whereby I represents an LED driving current, C represents an LED and PCB loading, $V_f$ represents an LED forward voltage, and $f_{GCLK}$ represents an GCLK frequency.

2. The LED display system according to claim 1, wherein the driver circuit comprises a register that is configured to store the offset value.

3. The LED display system according to claim 1, wherein the LED array comprises a plurality of common anode nodes, wherein each of the plurality common anode nodes is operably connected with anodes of LEDs of a same color in a corresponding column.

4. The LED display system according to claim 3, wherein each of the common anode nodes is operably connected with a power source.

5. The LED display system according to claim 1, wherein the LED array comprises a plurality of common cathode nodes wherein each of the plurality common cathode nodes is operably connected with cathodes of LEDs of a same color in a corresponding row.

6. The LED display system according to claim 5, wherein each of the common cathode nodes is operably connected with a power source.

7. The LED display system according to claim 1, wherein the LEDs are RGB LEDs or single color LEDs.

8. A method for operating an LED display, comprising the steps of:

connecting an array of LEDs to a driver circuit, wherein the driver circuit comprises a scrambled PWM generator, wherein the scrambled PWM generator is configured to generate a plurality of PWM pulses; and extending a width of each of the plurality of PWM pulses by an offset value, wherein the offset value equals N GCLK cycles, wherein $N=C*V_f*f_{GCLK}/I$, whereby I represents an LED driving current, C represents an LED and PCB loading, $V_f$ represents an LED forward voltage and $f_{GCLK}$ represents an GCLK frequency, whereby the pulse width with offset substantially matches a rise time ($T_r$) of a LED in the LED array.

9. The method for operating an LED display according to claim 8, further comprises the steps of determining the offset value; and loading the offset value into a register in the driver circuit.

10. The method for operating an LED display according to claim 8, wherein the LEDs in the LED array are arranged into rows and columns, wherein the LEDs are RGB LEDs or single color LEDs.

11. The method for operating an LED display according to claim 10, wherein the LED array comprises a plurality of common cathode nodes wherein each of the plurality common cathode nodes is operably connected with cathodes of LEDs of a same color in a corresponding row.

12. The method for operating an LED display according to claim 11, further comprising connecting a power source to a common cathode node of the LED array.

13. The method for operating an LED display according to claim 10, wherein the LED array comprises a plurality of common anode nodes wherein each of the plurality common anode nodes is operably connected with anodes of LEDs of a same color in a corresponding column.

14. The method for operating an LED display according to claim 13, further comprising connecting a power source to a common anode node of the LED array.

15. A method for operating an LED display, comprising:

connecting an array of LEDs to a driver circuit, wherein the driver circuit comprises a scrambled PWM generator, wherein the scrambled PWM generator is configured to generate a plurality of PWM pulses;

extending a width of each of the plurality of PWM pulses by an offset value;

determining the offset value; and loading the offset value into a register in the driver circuit, wherein the step of determining the offset value comprises the steps of:

loading a test value to the register so that the width of each of the plurality of PWM pulses is extended by the test value;

measuring a performance characteristic of the LED display in response to the test value;

repeating the loading step and the measuring step; and assigning the test value to the offset value when the test value results in a performance characteristics that satisfies a pre-determined criteria.

16. The method of claim 15, wherein the performance characteristics is a brightness, a visual refresh rate, or a resolution of the LED display.

* * * * *